United States Patent [19]

Lamos

[11] 4,068,837

[45] Jan. 17, 1978

[54] PAPER HOLD-DOWN DEVICE FOR COLLECTOR

[75] Inventor: Richard Allen Lamos, Boulder, Colo.

[73] Assignee: International Business Machines Corporation, Armonk, N.Y.

[21] Appl. No.: 727,872

[22] Filed: Sept. 29, 1976

[51] Int. Cl.[2] ..... B65H 31/26; B65H 31/24

[52] U.S. Cl. ..... 271/173; 214/6 D; 271/180; 271/220

[58] Field of Search ..... 271/173, 220, 178, 180, 271/181, 177, 179, 221, 222, 189, 223, 224, 64; 270/58; 214/6 D

[56] References Cited

U.S. PATENT DOCUMENTS

| | | | |
|---|---|---|---|
| 1,573,414 | 2/1926 | Mahoney | 271/220 X |
| 1,902,436 | 3/1933 | Joachim | 271/177 |
| 3,633,479 | 1/1972 | Bergstrom | 271/181 X |
| 3,638,937 | 1/1972 | Schulz et al. | 271/173 |
| 3,953,023 | 4/1976 | Cross et al. | 271/173 |
| 3,954,259 | 5/1976 | Gerbasi | 271/220 X |
| 3,957,264 | 5/1976 | Bach et al. | 271/173 |

FOREIGN PATENT DOCUMENTS

| | | | |
|---|---|---|---|
| 2,520,756 | 11/1975 | Germany | 271/181 |

*Primary Examiner*—Bruce H. Stoner, Jr.
*Attorney, Agent, or Firm*—Francis A. Sirr

[57] ABSTRACT

A paper hold-down device for a sheet collecting and stacking apparatus comprising a sheet hold-down arm disposed at the entrance to the apparatus for holding down the trailing edge of the stack at the entrance while the next sheet is fed onto the stack. A cam is fixed to a moving sheet feeding mechanism and acuates the hold-down arm as the feeding mechanism moves into alignment with the entrance to the apparatus. A spring is connected to the arm for returning it to its original position as the sheet feeding mechanism moves away from the entrance thus allowing the sheet that was just fed to join the others in the stack.

9 Claims, 4 Drawing Figures

PAPER HOLD-DOWN DEVICE FOR COLLECTOR

BACKGROUND OF THE INVENTION

In both copier/duplicator systems and duplicator/-printer systems there is need for collecting the copy sheets in organized stacks at the output of the equipment. For this purpose, various types of sheet collecting and stacking structures are available for attachment at the output of the duplicator equipment. Typically, such structure can function to either collect copy sheets in a single uncollated stack or to collect the sheets in separate bins with a single collated set in each bin. In this latter mode of operation, the copy sheets are stacked in their proper original/copy sequence. This is accomplished by stepping the sheet feeding means into alignment with the entrance to each bin to serially feed the sheets into the bins, the sheet feeding means moving from bin to bin as each single sheet is fed to the bin.

As sheets are stacked in the receiving bin or bins of the collecting and stacking apparatus, their trailing edges adjacent the entrance to the bin frequently tend to curl up. This quickly raises the height of the stack within the bin. With a limited access entrance to the bin, this curling of the trailing edges forms an obstruction at the entrance so that the next sheet fed to the bin will be blocked from entering. This, in turn, can cause damage to the sheets or even jamming of the apparatus.

Different devices have been developed to alleviate this condition and to provide a clear, unobstructed entrance to each bin as each sheet is fed therethrough. Mechanical devices of this type have included mechanisms for continuously engaging the trailing edge of the accumulated stack of sheets at the entrance to each bin to keep the entrance clear, multiple hold-down bars operating sequentially as each sheet is fed to the stack, and camming mechanisms for opening or widening the entrance to the bin as each sheet is fed therethrough. Pneumatic devices are also available for holding down the trailing edge of the stack. These devices employ means for directing an air blast at the trailing edge of the stack to keep all sheets lying flat.

Devices of the types described above possess certain disadvantages. Some are not positive acting in that they do not provide a positive clearance of the entrance. Devices which are based on blasting air or widening the entrance are examples. With pneumatic devices, the air blast also has the disadvantage of obstructing the free feeding of the sheet which, to some degree, must run counter to the air blast. Other devices actually provide a mechanical obstruction to the feeding of incoming sheets and the sheets are relied upon to open the obstruction.

SUMMARY OF THE PRESENT INVENTION

According to the teachings of the present invention, the improved sheet hold-down device includes a hold-down arm mounted at the entrance to each bin of the collecting and stacking apparatus. The arm is mounted for movement into and out of an operative position overlying the trailing edge of the stack of sheets at the entrance to each bin. The operative position of the arm also underlies the path of feeding of the next sheet onto the stack. Actuator means are provided for moving the hold-down arm into its operative position prior to the feeding of each sheet to the stack and out of its operative position after the feeding of each sheet.

With applicant's construction, the hold-down device for each bin remains inactive until the sheet feeding means is moved into operative position with that bin. With the control arm in operative position, the entrance is held open in a positive, reliable manner. The sheet which is fed onto the stack will initially rest on the stack with its trailing edge overlying the arm. After the sheet feeding means moves to the next bin, however, the arm will be released and will move from underneath the sheet and back into its inoperative position until the feeding of the next sheet to that bin.

DETAILED DESCRIPTION OF THE PREFERRED EMBODIMENT

Figure 1:
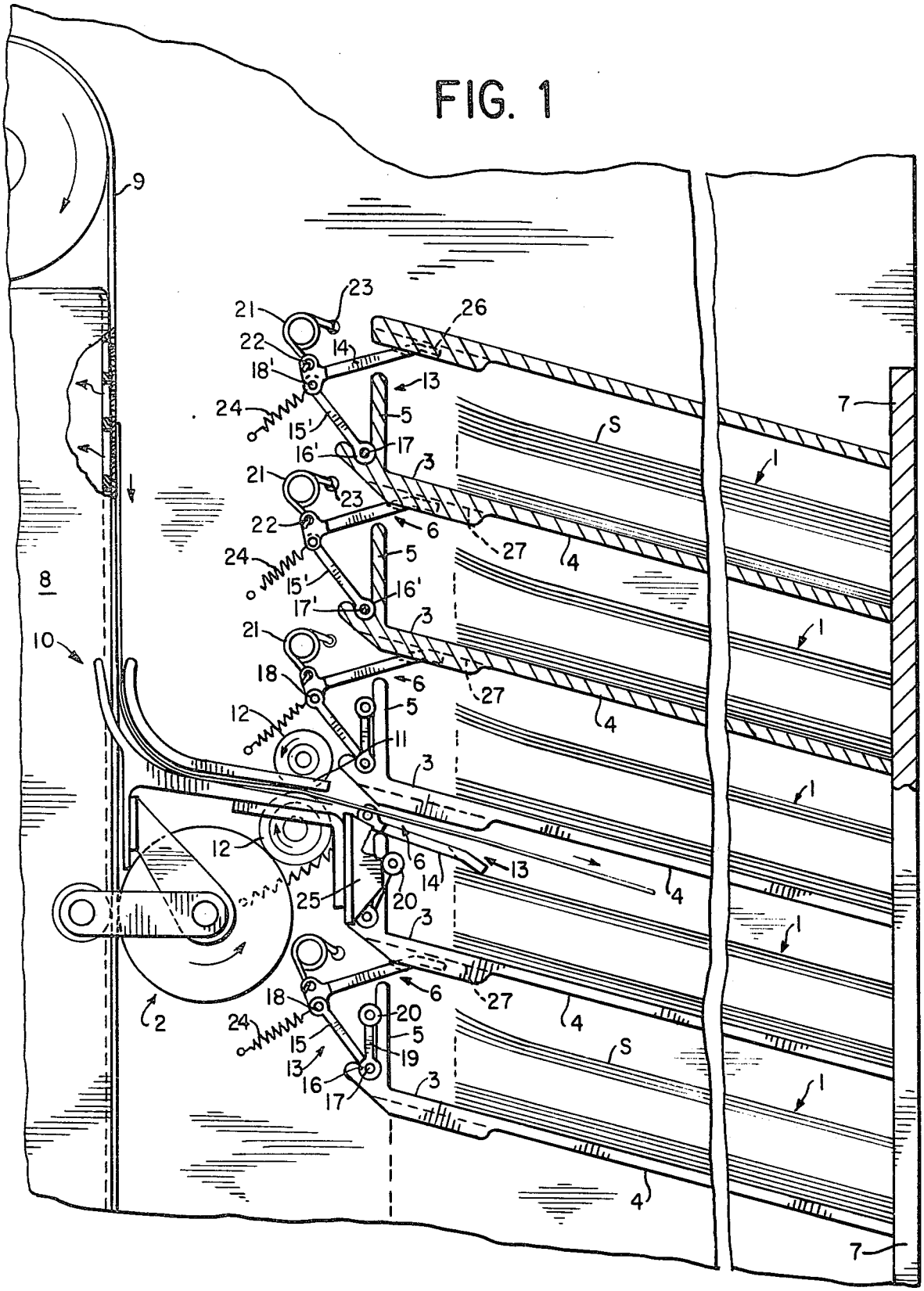
FIG. 1 is a side view of a sheet collecting and stacking apparatus with parts removed to show the improved sheet hold-down device of the present invention.

The hold-down device of the present invention is particularly suited for use in a collating type of sheet collecting and stacking apparatus. FIG. 1 shows such an apparatus as comprising a plurality of sheet collecting bins, generally designated by reference numeral 1, and a sheet feeding means generally designated by reference numeral 2, for feeding sheets serially to each bin. Each bin is constructed with a bottom support surface 3 and an overlying wall 4. The overlying wall also defines the bottom support surface for the next uppermost bin. At the front of each bin, an upwardly extending front wall 5 is provided. As shown, the upper surface of this wall is spaced from the overlying wall 4. This spacing provides an entrance 6 to the bin. The bin structure is completed by back wall 7. As shown in FIG. 1, the bins are tilted slightly to the horizontal and stacks of sheets S are collected in each bin. This orientation of the bins is not critical to the present invention. The bins can, for example, be arranged horizontally or vertically and the stacks of sheets still formed within each bin.

Where the sheet collecting and stacking apparatus functions as a collator, individual copy sheets exit from the output of a copier/duplicator or duplicator/printer equipment will be fed serially to each bin to form collated sets or stacks of copies in their proper original/-copy sequence. For this purpose, the sheet feeding means 2 is provided. This feeding means generally includes a vacuum plenum structure 8 over which a perforated pair of sheet transport drive belts 9 are run. The copy sheets are fed along the surface of the plenum drum and separated from the transport belts by means of a separator vane 10. The vane has a forward end 11 which is adapted to be aligned with the entrance to the bin into which the sheet is to be fed. Sheet feeding rollers 12 are provided at the forward end 11 to positively feed the sheets.

The sheet feeding mechanism, including the vane 10 and rollers 12, is adapted to be moved in stepwise fashion from bin to bin to serially feed individual sheets to each bin. Where the sheets are fed serially from the top bin to the bottom bin, the feeding means will be stepped downwardly from bin to bin; and after the bottommost bin has received its sheet, the feeding means will be moved upwardly in a continuous motion to its starting position aligned with the entrance to the topmost bin. Structure for effecting this operation of the sheet feeding means is conventional and forms no part of the present invention.

In accordance with the teachings of the present invention, a positive acting hold-down device is provided at the entrance to each bin. The hold-down device, generally designated at 13, is operable to positively clear the entrance of the bin of any upturned sheets. In construction, the hold-down device includes a sheet hold-down arm 14. The hold-down arm extends laterally across the entrance and is supported at the lateral side of the entrance by pivot link means 15, 15'. The pivot link means includes a single link at each side of the entrance which are, in turn, pivotally mounted at their lower ends 16, 16' for movement about a pivot axis 17. This axis extends laterally across the front of the bin at its base. The rear end of the arm 14 is pivotally connected to the upper end of each pivot link 15, 15' by means of pivot joints 18, 18'.

Figure 2:
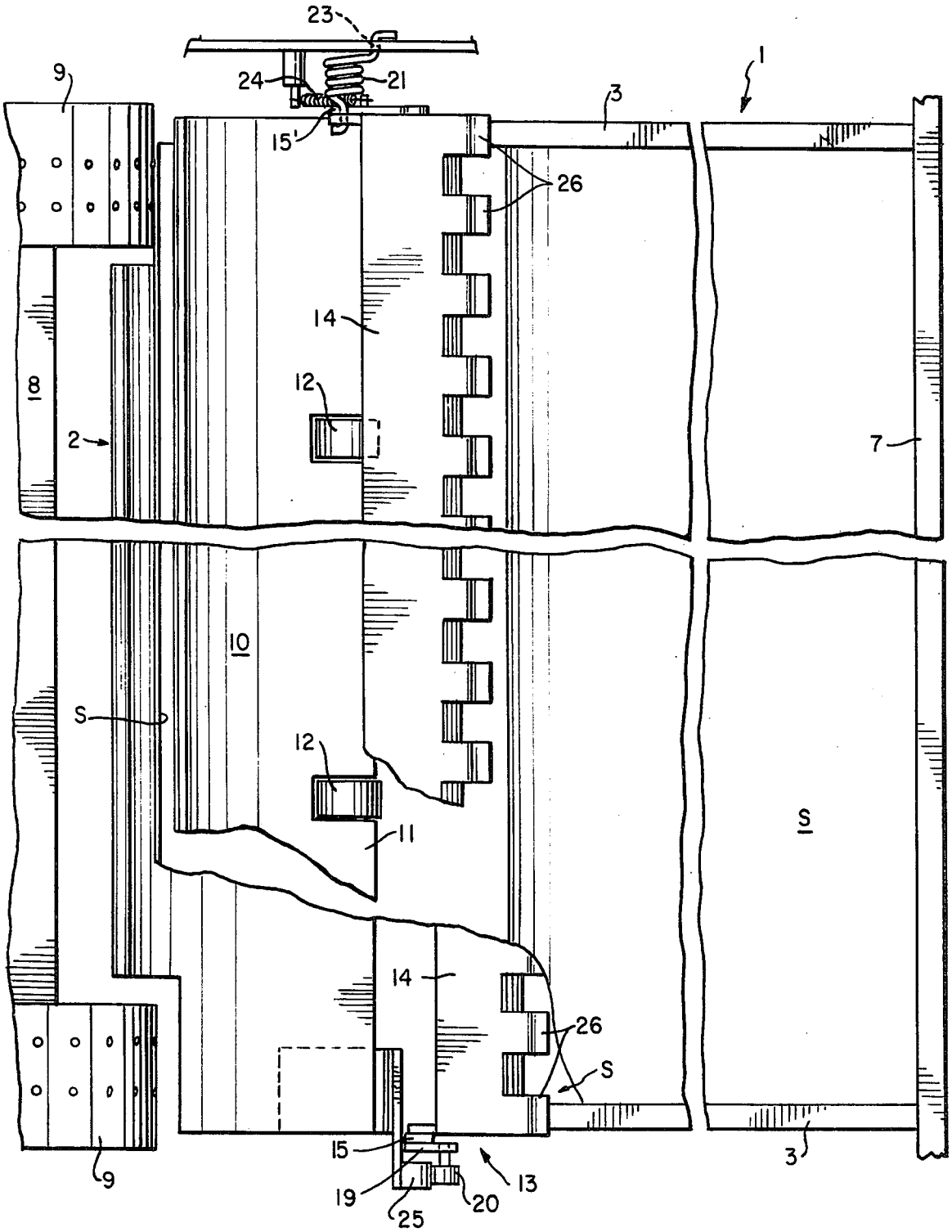
FIG. 2 is a top view of the apparatus shown in FIG. 1.

Actuator means are provided for effecting movement of the hold-down arm at each bin through an operative cycle each time the sheet feeding means moves into alignment with the entrance to that bin. In construction, part of this actuator means is operatively connected to the hold-down arm and part to the sheet feeding means. More specifically, as shown in FIGS. 1 and 2, a crank arm 19 is connected to the bottom end 16 of the link 15 for pivoting about the axis 17. This crank arm is fixed with respect to the link 15 and includes a follower means in the form of a cam roller 20 at its free end. On the other side of the entrance 6, a torsion, over-center spring 21 is pivotally connected at one end to the arm 14. This connection point 22 is made adjacent to pivot joint connection 18' of the arm to the pivot link 15'. The other end of the torsion spring is pivotally connected at a fixed point 23 to the collator housing structure. In addition, a tension return spring 24 is connected at one end to the upper end of the link 15' and at its other end to the collator housing structure. As will be more fully described below, the springs function as control means for controlling the path of movement of the hold-down arm through its cycle.

The actuator means for effecting movement of the hold-down arm under the control of the springs 21 and 24 includes an actuator cam 25 attached to the forward end of the separator vane 10 of the sheet feeding means 2. This cam is disposed in alignment with the cam roller 20 for engagement therewith as the feeding means moves into and out of alignment with the bin into which a sheet is to be fed.

Figure 3:
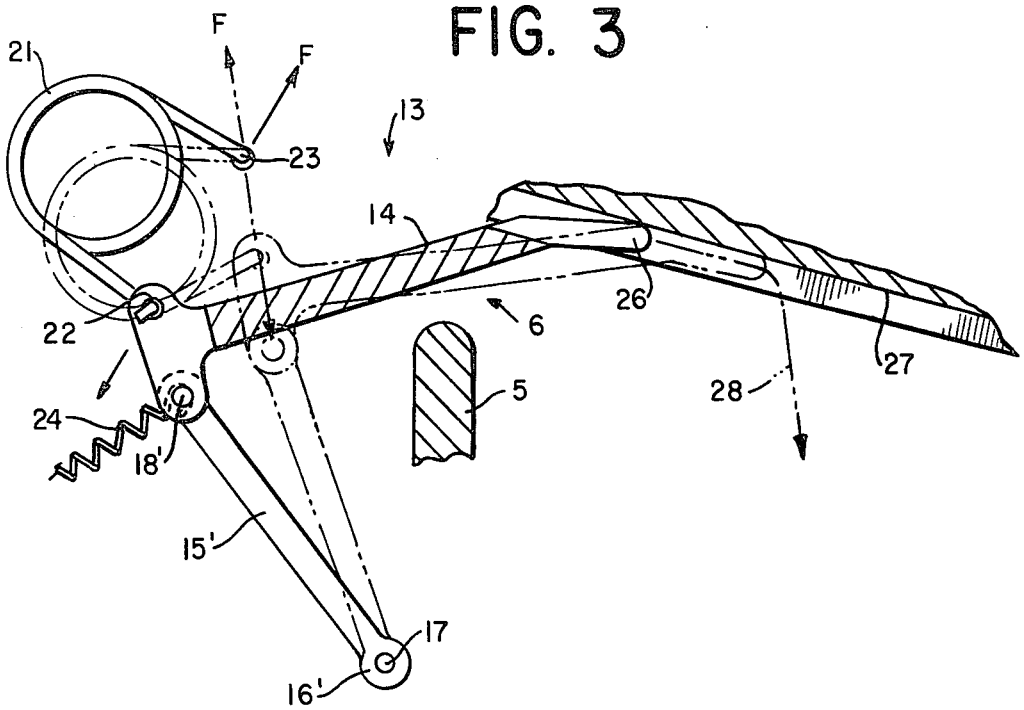
FIG. 3 is a view showing the initial movement of the hold-down device toward its operative position.

FIG. 3 shows the operation of the hold-down arm as it moves from its inoperative standby position toward its operative position overlying the stack of sheets and underlying the path of feeding of the sheet of a bin. The solid line position of the hold-down arm shown in FIG. 3 represents the standby inoperative position of the arm. In this position, the forwrd end of the arm is in engagement with the underneath surface of the top wall 4. To assure that the arm overlies all sheets in the bin when in this position, the forward end of the arm is provided with a plurality of laterally spaced fingers 26. These fingers extend in the direction of feeding of the sheets through the entrance to the bin and are disposed within complementary shaped recesses 27 formed in the front portion of the overlying wall 4. In this position of the hold-down arm, the torsion spring supplies a force F, the line of action of which causes a counterclockwise moment to be applied to the hold-down arm keeping its free end in contact with the underneath surface of the wall 4 and its fingers 26 within the recess 27.

As the sheet feeding means moves into alignment with the bin to which a sheet is to be fed, the actuator cam 25 engages the cam follower roller 20 and pivots the crank arm 19 and link 15, and also link 15', in a clockwise direction about the axis 17. As the pivot links are caused to rotate, their movement is in a clockwise direction but the counterclockwise moment applied by the torsion spring is maintained on the hold-down arm until the pivot link 15' reaches the phantom line position shown in FIG. 3. At this point, the line of action of the spring force F will be directed through both the pivot joint 18' and the point 22 where the spring 21 is connected to the arm.

As the link continues to rotate in a clockwise direction, the torsion spring force goes over center and its line of action will shift to the right of the pivot joint 18'. This will cause a clockwise moment to be applied to the hold-down arm and cause it to rotate in a clockwise direction. Under the influence of this clockwise moment, the free end of the hold-down arm will move downwardly in the direction represented by the broken arrow 28. The extent of this downward movement is controlled by the wall 5 of the bin structure. The upper surface of this wall acts as a stop; and when engaged by the arm, the cam will have moved into overlying relation with the trailing edge of the stack of sheets in the bin. This position is shown in FIG. 1. As is further evident from FIG. 1, the hold-down arm has also moved into a position underlying the path of feeding of the sheet into the bin so as to clear the entrance 6 of any upcurled sheet edges.

Figure 4:
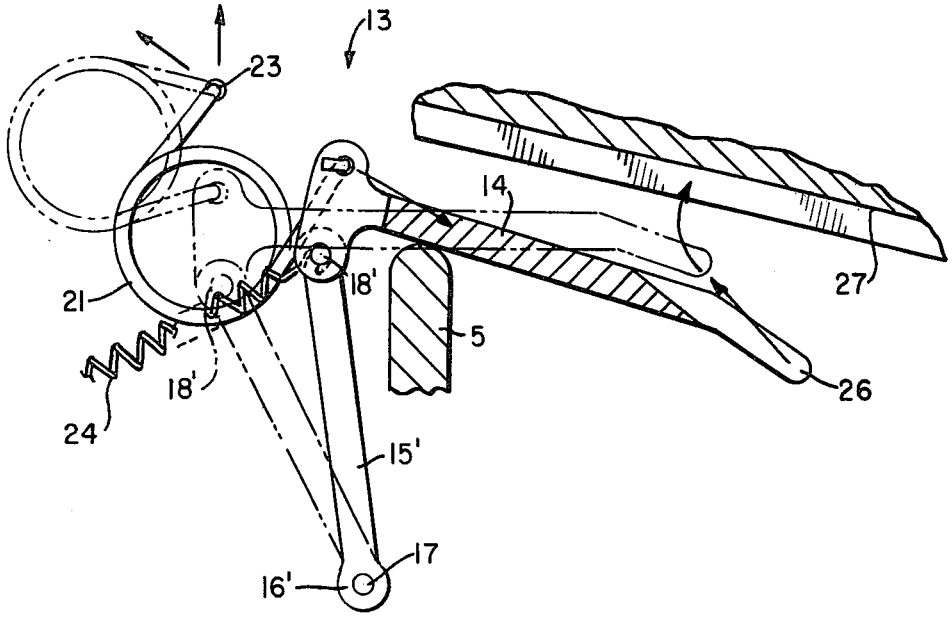
FIG. 4 is a view of the hold-down device showing its movement from an operative to an inoperative position.

After a sheet has been fed to the bin, its trailing edge will overlie the hold-down arm 14; and as the feeding means moves away from the bin, the actuator cam 25 moves out of engagement with the follower roller 20 and allows the links 15, 15' to rotate back in a counterclockwise direction. The return spring 24 assures this movememt; and as it occurs, the torsion spring 21 maintains the contact of the hold-down arm on the top surface of the wall 5. As shown in FIG. 4, this contact is maintained due to the rotative position of the torsion spring 21 and the line of action of the force F then produced by the torsion spring. The movement of the hold-down arm continues from the solid line position shown in FIG. 4 to the phantom line position. At this point, the line of action of the force F of the torsion spring goes over center and again applied a counterclockwise moment to the hold-down arm causing it to move upwardly until it contacts the lower surface of the wall 4 and is again in its inoperative standby position.

After the feeding means has been stepped downwardly to the bottommost bin, it is returned in one continuous movement to the uppermost bin for recycling. During this upward movement the actuator cam 25 will momentarily actuate each of the hold-down devices. Where such actuation is to be avoided, a suitable solenoid mechanism not shown, may be attached to the separator vane to retract the actuator cam from alignment with the follower rollers 20 during this upward movement. Also, although the hold-down device has been described in connection with a collator having a plurality of bins, it is within the scope of this invention to use this hold-down device with a collecting and stacking apparatus where a single bin is provided. In such a case, the feeding means may be moved into and out of repeated alignment with the bin or the actuator cam can simply be moved into and out of engagement with the cam follower for each sheet fed to the bin.

I claim:

1. In a sheet collecting and stacking apparatus having support means for collecting a plurality of sheets in stacked relation, an entrance at one side of said support means, and feeding means for feeding sheets through said entrance and into superimposed relation with previous sheets stacked on said support means, said feeding means being mounted for movement from a first position out of alignment with said entrance to a second position aligned with said entrance when a sheet is to be fed therethrough, an improved sheet hold-down device for holding the trailing edge of the sheets of the stack down at said entrance to prevent obstruction thereof and permit feeding of the next sheet therethrough and into said superimposed relation with said stack, said hold-down device comprising:

a. a sheet hold-down arm;

b. support means for supporting the hold-down arm for movement between a first standby position spaced from the trailing edge of the stack and a second operative position disposed in overlying relation with the trailing edge of the stack and in underlying relation to the path of feeding of the next sheet onto said stack; and c. actuator means for effecting movement of the hold-down arm between said first and second positions, said actuaor means including:

1. a first part operatively connected to said hold-down arm, and 2. a second part opertively connected to said feeding means for movement therewih, said first part being disposed in the path of movement of the second part for contact thereby as said feeding means moves into its second position aligned with said entrance to actuate said hold-down arm and cause movement thereof from said first position to said second position.

2. In a sheet collecting and stacking apparatus according to claim 1 where the entrance is bounded on the bottom by the support means and on the top by an overlying wall with a front portion extending laterally across the entrance, said support means and overlying wall defining the bottom and top of a bin for said stack of sheets, the improved sheet hold-down device wherein:

a. the sheet hold-down arm extends laterally across the entrance; and b. the support means is connected to said arm at the lateral side of said entrance for supporting said arm for movement between said first and second positions.

3. In a sheet collecting and stacking apparatus according to claim 1 where the entrance is bounded on the bottom by the support means and on the top by an overlying wall with a front portion extending laterally across the entrance, said support means and overlying wall defining the bottom and top of a bin for said stack of sheets, the improved sheet hold-down device wherein:

a. the arm includes a plurality of laterally spaced fingers extending in the direction of feeding of the sheets through said entrance;

b. the front portion of said overlying wall includes a bottom surface having laterally spaced recesses for receiving said fingers when said arm is disposed in said first standby position; and c. said actuator means further includes control means for controlling the movement of said arm and fingers prior to feeding of each sheet to said stack first in the direction of feeding of the sheets and into direct overlying relation with the trailing edge of the stack while the fingers are disposed in said recesses of the overlying wall and then in a downward direction to said second position overlying the trailing edge of the stack and underlying the path of feeding of the next sheet onto the stack, said movement being effected by contact of the first and second parts of the actuator means as the feeding means moves into alignment with said entrance.

4. In a sheet collecting and stacking apparatus according to claim 1 where the entrance is bounded on the bottom by the support means and on the top by an overlying wall with a front portion extending laterally across the entrance, said support means and overlying wall defining the bottom and top of a bin for said stack of sheets, and where the apparatus includes a plurality of overlying bins with the overlying wall of one bin defining the support means for a next overlying bin and the feeding means moves vertically from bin to bin into successive alignment with the entrance to each bin, the improved sheet hold-down device for each bin wherein:

a. the support means for the hold-down arm includes:

1. pivot link means pivotally mounted at one end for movement about a pivot axis extending perpendicular to the path of movement of said sheets through said entrance, and 2. a pivot joint at the other end of the pivot link means for connecting said arm thereto;

b. the first part of the actuator means includes:

1. cam follower means fixed to said pivot link means, and 2. control means including a torsion, over-center spring means connected to said arm adjacent the connection of the arm to said pivot link means for controlling movement of said arm to a generally circular path from said standby position, first in the direction of feeding of said sheets through said entrance while at a location spaced above the trailing edge of said stack, then in a downward direction to said second operative position underlying the path of feeding of the sheets, then in a reverse direction opposite the path of feeding of the sheets until located off the stack and finally in an upward direction back to said standby position; and c. the second part of the actuator means includes:

1. an actuator cam fixed to said feeding means for engagement with the cam follower means associated with each bin as the feeding means moves into alignment with its entrance to cause pivoting of the pivot link means at its one end and controlled movement of the arm as set out in paragraph (b) (2) above.

5. In a sheet collecting and stacking apparatus according to claim 4, the improved sheet hold-down device wherein:

a. the arm includes a plurality of laterally spaced fingers extending in the direction of feeding of the sheets through said entrance; and b. the front portion of each overlying wall includes a bottom surface having laterally spaced recesses for receiving said fingers when said arm is disposed in said first standby position.

6. In a sheet collecting and stacking apparatus according to claim 5, the improved sheet hold-down device wherein:

a. said control means further includes a stop positioned in the path of downward movement of the hold-down arm to limit such movement.

7. In a sheet collecting and stacking apparatus according to claim 6, the improved sheet hold-down device wherein:

a. said cam follower means includes a crank arm fixed at one end to the one end of the pivot link means and having a cam follower member at the other end disposed in the path of movement of the actuator cam; and b. the conrol means further includes a tension spring means connected to said pivot link means for urging it and the crank arm in one direction of rotation about the pivot axis and back to its original position as the feeding means moves out of alignment with said entrance and said actuator cam moves out of engagement with said cam follower member.

8. In a sheet collecting and stacking apparatus according to claim 7, the improved sheet hold-down device wherein:

a. the pivot link means includes a pivot link connected to said arm at each lateral side of the entrance;

b. the spring means is connected to said arm and one pivot link at one side of the entrance; and c. the crank arm is connected to the pivot link at the other side of the entrance.

9. In a sheet collecting and stacking apparatus having support means for collecting a plurality of sheets in stacked relation, an entrance at one side of said support means, and feeding means for feeding sheets through said entrance and into superimposed relation with previous sheets stacked on said support means, said feeding means being mounted for movement from a first position out of alignment with said entrance to a second position aligned with said entrance when a sheet is to be fed therethrough, and improved sheet hold-down device for holding the trailing edge of the sheets of the stack down at said entrance to prevent obstruction thereof and permit feeding of the next sheet therethrough and into said superimposed relation with said stack, said hold-down device comprising:

a. a sheet hold-down arm;

b. support means for supporting the holddown arm for movement between a first standby position spaced from the trailing edge of the stack and a second operative position disposed in overlying relation with the trailing edge of the stack and in underlying relation to the path of feeding of the next sheet onto said stack; and c. actuator means including means responsive to movement of said feeding means into its second position to actuate said hold-down arm and cause movement thereof from said first position to said second position as said feeding means moves into its second position.

* * * * *